US007108223B2

(12) United States Patent
Chasman et al.

(10) Patent No.: US 7,108,223 B2
(45) Date of Patent: Sep. 19, 2006

(54) MISSILE CONTROL SYSTEM AND METHOD

(75) Inventors: Daniel Chasman, Tucson, AZ (US); Stephen D. Haight, Tucson, AZ (US); Andrew B. Facciano, Oro Valley, AZ (US)

(73) Assignee: Raytheon Company, Lexington, MA (US)

( * ) Notice: Subject to any disclaimer, the term of this patent is extended or adjusted under 35 U.S.C. 154(b) by 89 days.

(21) Appl. No.: 10/289,651

(22) Filed: Nov. 7, 2002

(65) Prior Publication Data

US 2005/0011989 A1 Jan. 20, 2005

(51) Int. Cl.
*F42B 10/66* (2006.01)
*F02K 9/80* (2006.01)

(52) U.S. Cl. ..... 244/3.22; 244/3.1; 244/3.15; 244/3.21

(58) Field of Classification Search ..... 244/52, 244/3.1–3.3

See application file for complete search history.

(56) References Cited

U.S. PATENT DOCUMENTS

| | | | | |
|---|---|---|---|---|
| 3,046,736 | A | 7/1962 | Thomson | |
| 3,052,090 | A | 9/1962 | Herzog | |
| 3,115,747 | A | 12/1963 | Ying-Nien | |
| 3,147,591 | A | 9/1964 | McEwen | |
| 3,650,348 | A | 3/1972 | Colebrook et al. | |
| 4,023,749 | A | 5/1977 | McCorkle, Jr. | |
| 4,085,909 | A | 4/1978 | East et al. | 244/3.21 |
| 4,131,246 | A | 12/1978 | Rotmans | 244/3.22 |
| 4,163,534 | A | 8/1979 | Seeger | 244/3.22 |
| 4,432,512 | A | 2/1984 | Young | |
| 4,745,861 | A | 5/1988 | Fenton et al. | |
| 4,826,104 | A | 5/1989 | Bennett et al. | |
| 4,867,393 | A | 9/1989 | Faupell et al. | 244/3.22 |
| 4,913,379 | A | 4/1990 | Kubota et al. | 244/3.22 X |
| 5,343,698 | A | 9/1994 | Porter et al. | |
| 5,456,425 | A | 10/1995 | Morris et al. | 244/3.22 |
| 5,505,408 | A | 4/1996 | Speicher et al. | 244/3.22 X |
| 5,511,745 | A | 4/1996 | Faupell et al. | 244/3.22 |
| 5,662,290 | A | 9/1997 | Voigt | 244/3.22 |
| 5,887,821 | A | 3/1999 | Voigt et al. | 244/3.27 X |

FOREIGN PATENT DOCUMENTS

| | | |
|---|---|---|
| DE | 1 153 657 | 8/1963 |
| DE | 1 170 284 | 5/1964 |
| FR | 1 217 708 | 5/1960 |

OTHER PUBLICATIONS

Saturn V Flight Manual AS 506, no date, no arthor; posted on the Internet at www.apollosaturn.com; section entitled "S–IC Stage."*

International Search Report, Application No. PCT/US03/35237, Filing Date: Nov. 7, 2002.

U.S. Appl. No. 10/288,943, filed Nov. 6, 2002, entitled Multi–Nozzle Grid Missile Propulsion System.

D.B. Saharon, "Turbulence Effect on Crossflow Around a Circular Cylinder at Subcritical Reynolds Numbers" Master thesis, Colarado State University, Ft. Collins, Colorado, Mar. 1982.

(Continued)

*Primary Examiner*—Bernarr E. Gregory
(74) *Attorney, Agent, or Firm*—Renner, Otto, Boisselle & Sklar, LLP

(57) ABSTRACT

A missile includes a tail section having a multi-nozzle grid with both fixed nozzlettes, and movable, thrust vector nozzlettes. The movable nozzlettes may be configured in a number of discrete array bars, each containing multiple of the movable nozzlettes. Movement of one or more array bars may be used to vector the thrust of the missile, providing roll, yaw, or spinning of the missile, for example.

26 Claims, 6 Drawing Sheets

OTHER PUBLICATIONS

H. Seifert and M. Summerfield, "Space Technology", H. Siefert ed. pp. 14–26, N.Y., John Wiley and Sons, Inc. 1959.
D. Chasman, "Characteristic Gap: A New Design Criterion for Solid Rocket Motors." Technical Note, Journal of Propulsion, vol. 17, No. 1, pp. 216–218, Washington DC:, Mar. 2000.
E. Oberg, F.D. Jones, and H.L. Horton, "Machinery's Handbook", 23rd Edition, p. 66.

* cited by examiner

MISSILE CONTROL SYSTEM AND METHOD

TECHNICAL FIELD

The invention relates to missile systems, and in particular to missile systems with thrust vector control.

BACKGROUND OF THE RELATED ART

Offensive missiles such as any number of cruise missiles are constructed to fly at low altitudes, just above treetops or water surfaces, to avoid detection by enemy radar. In such situations a targeted ship, for example, may have just a few seconds to first identify the threat and then take countermeasures such as firing one of its defensive missiles. Normally, a land or ship borne defensive missile is launched from a canister or missile launcher in a generally vertical direction, and it must first achieve sufficient velocity before its airfoil surfaces are able to effect any substantial maneuvers. This generally translates into having the missile reach an altitude of thousands of feet before it is able to pitch over and begin seeking the incoming missile threat. The time needed for these maneuvers is considered much too long.

A number of systems have been developed in an attempt to address this problem. Some of these concepts may be categorized as jet tabs, moveable nozzles, liquid injections and jet vane systems. However, devices using these systems are generally inadequate for many current applications. Retractable jet vanes, for example, are incompatible with the need for folding missile tail control surfaces, a necessary requirement for any launch canister loaded missile with stringent volume constraints.

Detachable jet tab systems including auxiliary propulsion units pivotally attached to the missile fins for coupled bidirectional motion, similarly conflict with folding control surfaces and require increases in the launch canister cross-section for additional volume external to the missile fuselage structure. A systems of this sort is shown in U.S. Pat. No. 4,844,380.

Moveable nozzle systems are heavy and complicated and are not detachable. Liquid injection systems do not provide sufficient thrust vector angles.

Existing jet vane mechanisms are either nondetachable or incorporate actuation systems with feedback control electronics redundant to the missile's steering control unit. Nondetachable jet van mechanisms limit missile range and performance with rocket thrust degradation throughout the missile's trajectory. Self actuation jet vane mechanisms are also heavy and inherently complicated, hence, require more rocket propellant for missile launch and lack sufficient reliability.

A shipboard defense system made by Raytheon and used on the Canadian SEA SPARROW missile system has vanes in the missile exhaust plume. However, this system includes elements that are redundant to those found on the missile, which adds unnecessary weight, is overly complicated and is very costly.

The numerous prior attempts to provide missile control at launch has yet to produce an optimal system.

Hence, there is a need in the art for further improvements in systems and techniques for providing missile control during launch.

SUMMARY OF THE INVENTION

According to an aspect of the invention, a missile includes a plurality of fixed nozzlettes and a plurality of movable nozzlettes.

According to another aspect of the invention, a missile includes a nozzle plate with a plurality of fixed nozzlettes in a cruciform configuration, with movable nozzlettes between arms of the cruciform configuration.

According to still another aspect of the invention, a missile includes a nozzle grid with a plurality of fixed nozzlettes, and a plurality of movable nozzlettes; and a pressurized gas source operatively coupled to the nozzle grid.

According to yet another aspect of the invention, a missile includes a thrust vector control system; and an aerodynamic control system mechanically coupled to the thrust vector control system.

According to a further aspect of the invention, a method of propelling a missile includes: moving high pressure gas through a plurality of fixed nozzlettes, to thereby provide thrust to propel the missile; and simultaneously moving the high pressure gas through a plurality of movable nozzlettes, to thereby provide additional thrust to propel the missile. The moving of the gas through the movable nozzlettes controls at least one of the following: course of the missile, orientation of the missile, and spin rate of the missile.

To the accomplishment of the foregoing and related ends, the invention comprises the features hereinafter fully described and particularly pointed out in the claims. The following description and the annexed drawings set forth in detail certain illustrative embodiments of the invention. These embodiments are indicative, however, of but a few of the various ways in which the principles of the invention may be employed. Other objects, advantages and novel features of the invention will become apparent from the following detailed description of the invention when considered in conjunction with the drawings.

BRIEF DESCRIPTION OF DRAWINGS

In the appended drawings, which may not necessarily be to scale.

DETAILED DESCRIPTION

A missile includes a tail section having a multi-nozzle grid with both fixed nozzlettes, and movable, thrust vector nozzlettes. The movable nozzlettes may be configured in a number of discrete array bars, each containing multiple of the movable nozzlettes. Movement of one or more array bars may be used to vector the thrust of the missile, providing roll, yaw, or spinning of the missile, for example.

Figure 1:
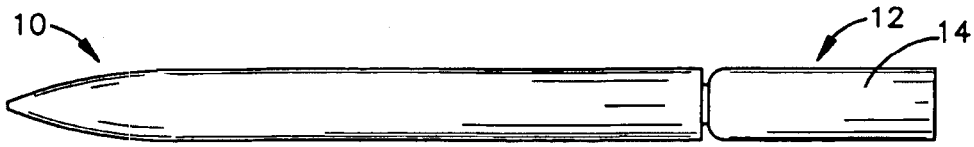
FIG. 1 is a side view of a missile in accordance with the present invention.
Figure 2:
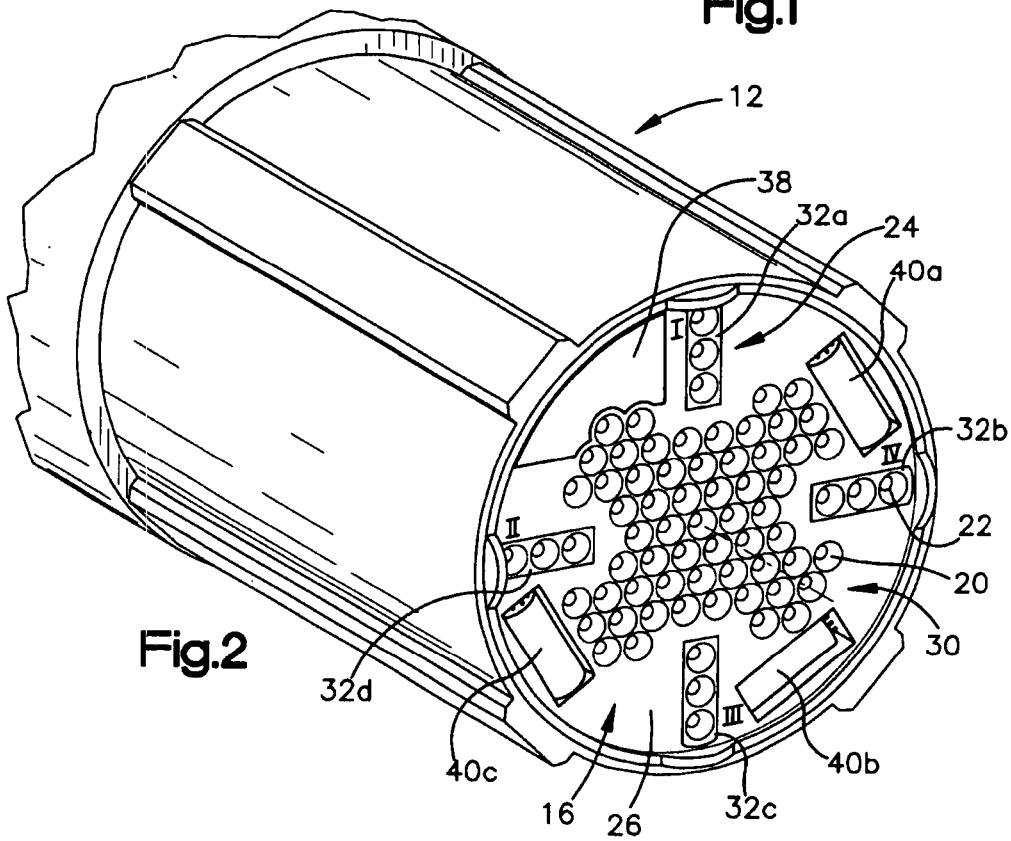
FIG. 2 is an isometric rear view of the missile of FIG. 1.

Referring initially to FIGS. 1 and 2, a missile or projectile 10 includes a tail section 12 having a pressurized gas source 14 and a nozzle grid 16. The pressurized gas source may produce high pressure gases by combustion of a propellant, such as any of a variety of conventional rocket fuels. Alternatively, the high-pressure chamber may receive gases from another suitable source of high-pressure gases. In addition, the pressurized gas source 14 may include multiple sources of pressurized gases.

The nozzle grid 16 is operatively coupled to the pressurized gas source 14 to expand the pressurized gases through use of convergent-divergent nozzles. The nozzle grid 16 includes a plurality of small nozzles, referred to herein as nozzlettes. The nozzlettes include both fixed nozzlettes 20 and movable, thrust vector nozzlettes 22, which are parts of a thrust vector control system 24. The nozzlettes 20 and 22 may be combined in a single nozzle plate 26. As shown in FIG. 2, the fixed nozzlettes 20 may be arranged in a cruciform configuration 30. The movable nozzlettes 22 may be arranged in a number of array bars 32*a*–32*d*, which at least in part are located between arms of the cruciform configuration 30 of the fixed nozzlettes 20. As explained in greater below, each of the array bars 32*a*–32*d* may have multiple of the movable nozzlettes 22 arrayed substantially parallel to one another. As shown, there may be four of the array bars 32*a*–32*d*, arranged symmetrically about an axis of the tail section 12. The array bars 32*a*–32*d* may be placed in openings in the nozzle plate 26, and may be configured to rotate or tilt relative to the nozzle plate 26. As described further below, there may be motors corresponding to respective of the array bars 32*a*–32*d*, for tilting the array bars.

Controller electronics 38 may be operatively coupled to the motors, to control operation of the motors, and thus the orientation of the array bars 32*a*–32*d*. The controller electronics 38 may receive data indicating the position and/or orientation of the missile 10. The data may be processed in the controller electronics 38 to detect deviations from the desired course, orientation, and/or spin rate of the missile 10. The controller electronics 38 may then send signals to re-orient the array bars 32*a*–32*d* to correct the course, orientation, and/or spin rate of the missile 10, to desired parameters. The controller electronics may include well-known electronic devices, such as processors utilizing integrated circuits. Batteries 40*a*–40*c* may be used to provide power to the motors and/or to the control electronics 38. The control electronics 38 and the batteries 40*a*–40*c* may be located between adjacent of the pairs of the array bars 32*a*–32*d*.

It will be appreciated that the embodiment described above is only one example of a large variety of suitable ways of arranging the various components. For example, it will be appreciated that a different number and/or arrangement of array bars may be utilized. Further, the term "array bar" will be understood to encompass a wide variety of devices that link multiple of the movable nozzlettes 22 to allow the movable nozzlettes 22 to be moved together. Such array bars may have other shapes than the generally rectangular array bars 32*a*–32*d* shown in FIG. 2.

Figure 3:
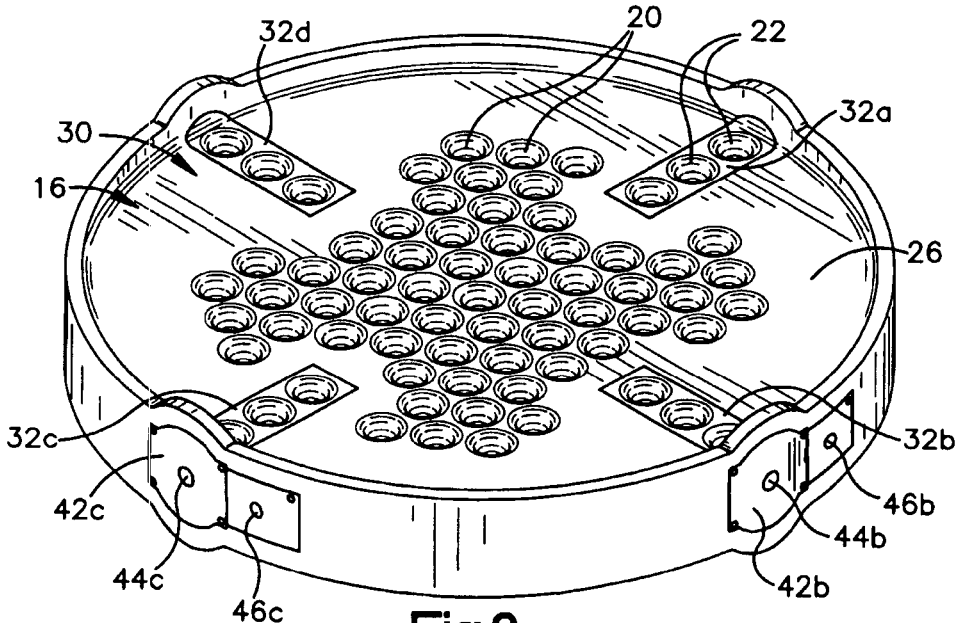
FIG. 3 is an isometric view of a nozzle plate of the control system of FIG. 2.

Turning now to FIG. 3, additional details of the nozzle plate 26 and associated parts are shown. The array bars 32*a*–32*d* fit into cavities in the nozzle plate 26. Covers 42*a* and 42*b* cover the cavities in which the array bars 32*a*–32*b* and the corresponding motors are located. The covers 42*b* and 42*c* may have one or more holes in them, for example allowing an array bar pin 44*b* and 44*c* and a motor shaft 46*b* and 46*c* to protrude into the holes. The covers 42*b* and 42*c* may be coupled to the nozzle plate 26 via screws or other suitable fasteners.

Figure 4:
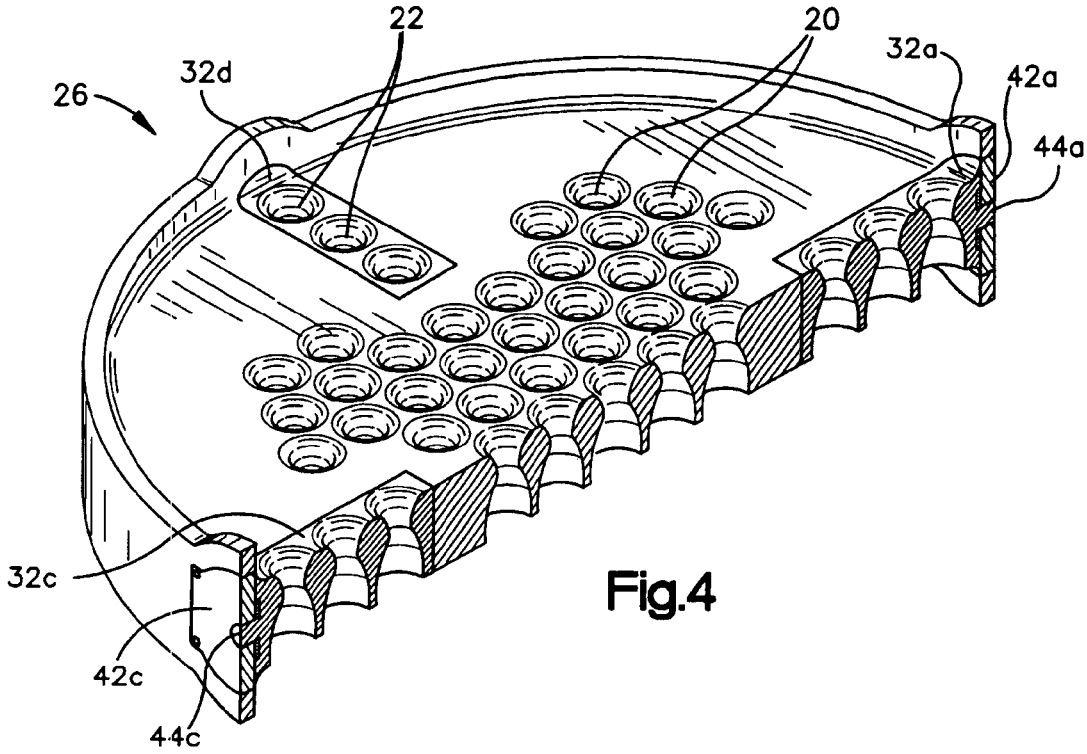
FIG. 4 is a cut-away view of the nozzle plate of FIG. 3.

FIG. 4 shows a cut-away view of the nozzle plate 26, illustrating one possible configuration of the fixed nozzlettes 20 and the movable nozzlettes 22. The array bars 32*a* and 32*c* have array bar pins 44*a* and 44*c* on both sides thereof. As will be described in greater detail below, corresponding motors may be used to tilt the array bars 32*a*–32*d* about their respective pins.

One side of the nozzle plate 26 may be in communication with a high-pressure chamber that receives high-pressure gases from the pressurized gas source 14 (FIG. 1). The chamber may be configured so that all of the nozzlettes 20 and 22 are in communication with the chamber. Thus, placement of high-pressure gases in the high-pressure chamber may be sufficient to cause outflow gases through both the fixed nozzlettes 20 and the movable nozzlettes 22.

It will be appreciated that other suitable arrangements may be utilized to provide the high-pressure gases to the nozzlettes 20 and 22. For example, multiple chambers and/or high-pressure gas sources may be employed.

As shown in the figures, each of the fixed nozzlettes 20 and the movable nozzlettes 22 may have substantially the same dimensions. However, it will be appreciated that nozzlettes having different configurations may be utilized where suitable. For example, the fixed nozzlettes 20 may have a different configuration than the movable nozzlettes 22. Also, some of the fixed nozzlettes 20 may have different configurations than other of the fixed nozzlettes 20, and/or some of the movable nozzlettes 22 may have a different configuration than other of the movable nozzlettes. Further, the number and/or arrangement of the fixed nozzlettes 20 and/or the movable nozzlettes 22 may be other than as shown.

Figure 5:
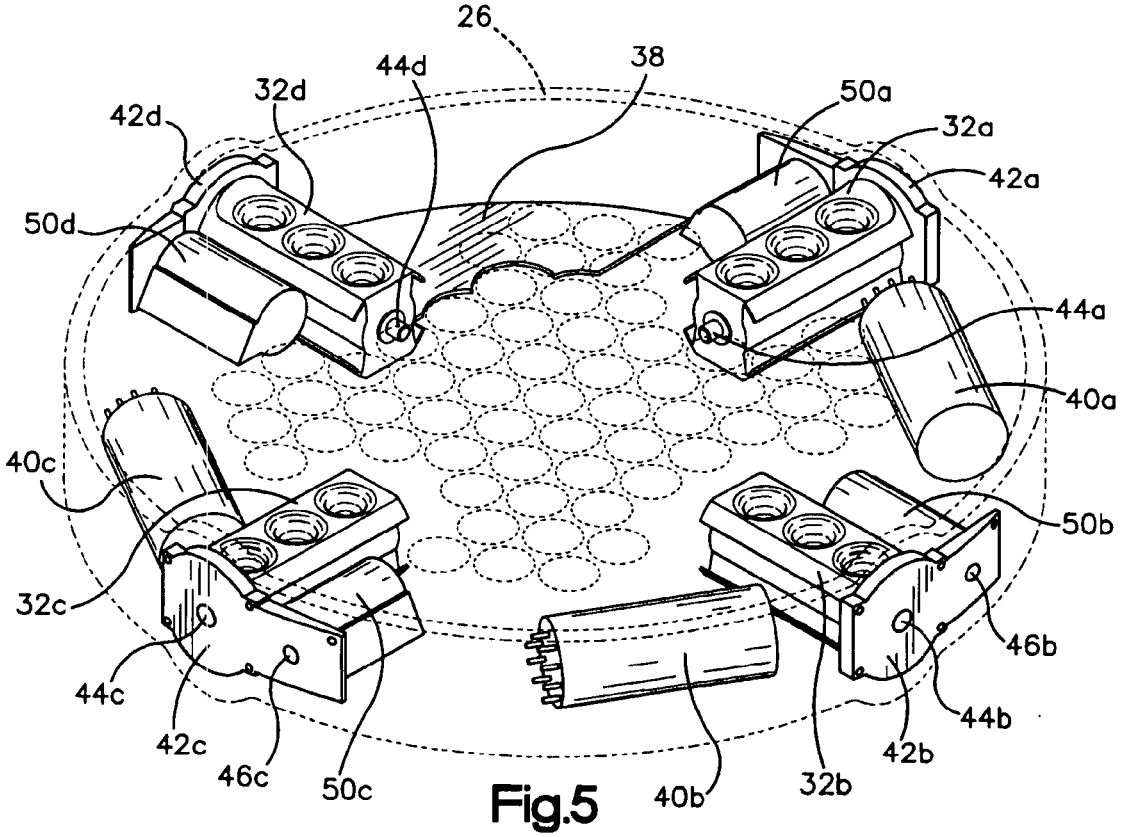
FIG. 5 is an isometric illustration showing components that fit into the nozzle plate of FIG. 3.

FIG. 5 shows the arrangements of other components within the nozzle plate 26 (shown by broken lines in FIG. 5). Specifically, the covers 42*a*–42*d* corresponding to the array bars 32*a*–32*d* are shown. Also shown are the array bar pins 44*a*–44*d* of the array bars 32*a*–32*d*. The motors 50*a*–50*d* are shown as well.

Figure 6:
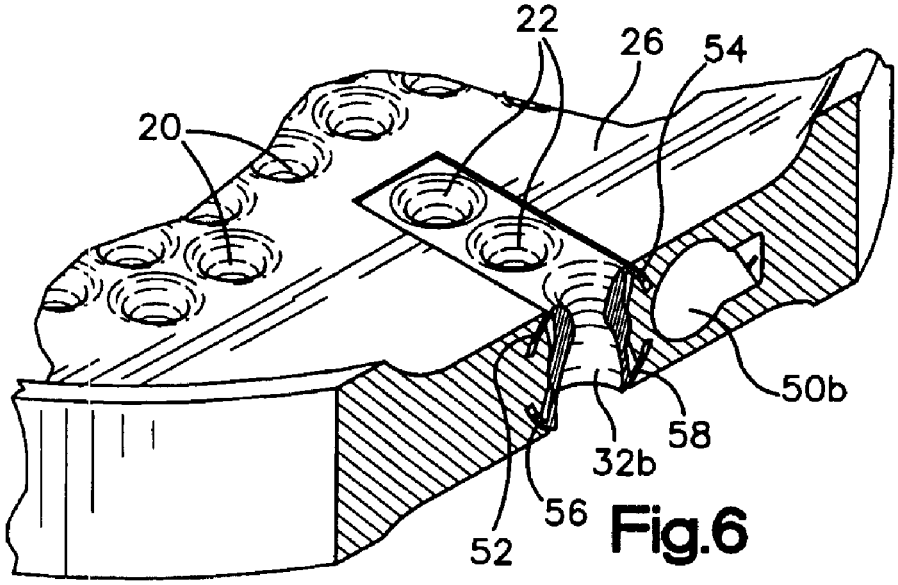
FIG. 6 is an isometric cut-away view illustrating details of the array bar and the nozzle plate of FIG. 3.
Figure 7:
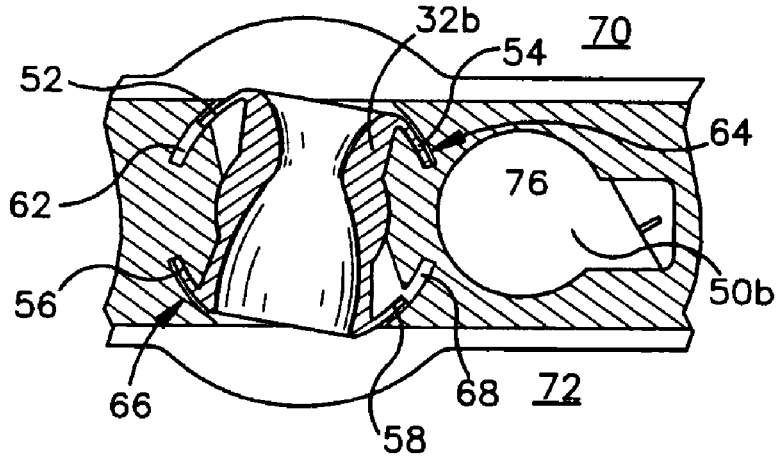
FIGS. 7 and 8 are side views of the cut-away of FIG. 6, showing further details.
Figure 8:
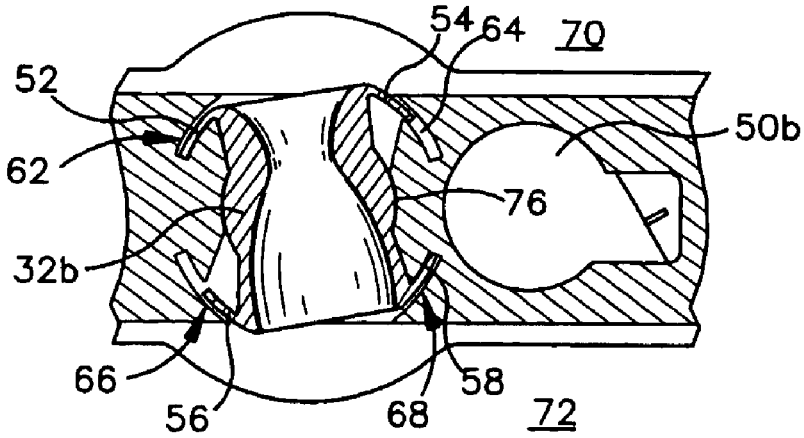

Turning now to FIGS. 6–8, a sealing mechanism, for sealing the array bars 32*a* relative to the nozzle plate 26, is shown. Similar sealing mechanisms may be utilized for the other array bars 32*a*, 32*c*, and 32*d*. The array bar 32*b* has deformable extensions 52, 54, 56, and 58, which fit into corresponding extension cavities 62, 64, 66, and 68, in the nozzle plate 26. High pressure above the nozzle plate 26, such as in a high-pressure chamber 70, causes the deformable extensions 52 and 54 to bend downward, pushing them against walls of the corresponding extension cavity 62 and 64.

Similarly, high pressure in a cavity 72, below the nozzle plate 26, causes the deformable extensions 56 and 58 to press upon walls of the corresponding cavity 66 and 68. The deformable extensions 52–58 of the array bar 32*b* thus operate to prevent exhaust gases, which may have a greatly elevated temperature, from reaching a lubricant 76 between the array bar 32*b* and the nozzle plate 26. The lubricant 76 may be a material, such as graphite, which may be degraded or destroyed by exposure to hot gases, such as those produced by combustion of rocket fuel. The self-sealing feature of the array bars 32*a,* with its extensions 52–58, prevents charring or other degradation of the lubricant 76.

The nozzle plate 26 and the array bars 32*a*–32*d* may be made of any of a variety of suitable materials, such as glass- or graphite-reinforced phenolic materials. Multi-ply woven fabric inserts may be employed to strengthen the reinforced phenolic material.

The nozzle plate 26 may have any of a variety of suitable thicknesses, for example, ranging from 0.25 inch (6.4 mm) to 2 inches (51 mm).

Use of a material such as the phenolic material described above allows casting of the nozzle plate 26 and/or the array bars 32*a*–32*d*. It will be appreciated that casting may significantly reduce manufacturing costs, when compared to other processes such as machining.

Ceramic inserts may be placed in the nozzlettes 20 and 22 to allow operation at higher temperatures and/or for longer periods of time, than are possible with use of plain phenolic materials. Suitable ceramic compounds may be enriched with carbon, zirconium, and/or metals such as aluminum, in order to provide desired properties.

Figure 9:
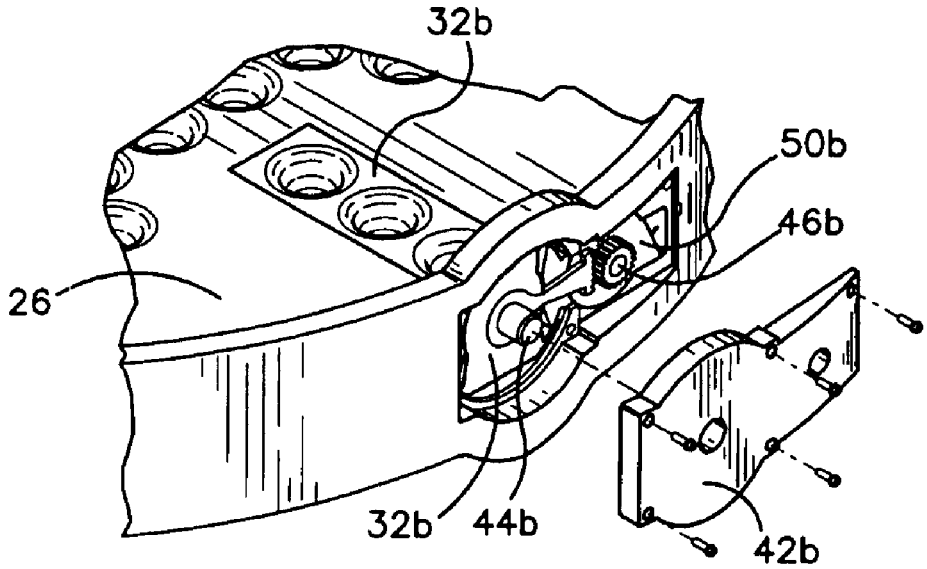
FIG. 9 is an exploded view showing the mechanical linkage between the motor and an array bar of the control system of FIG. 2.
Figure 10:
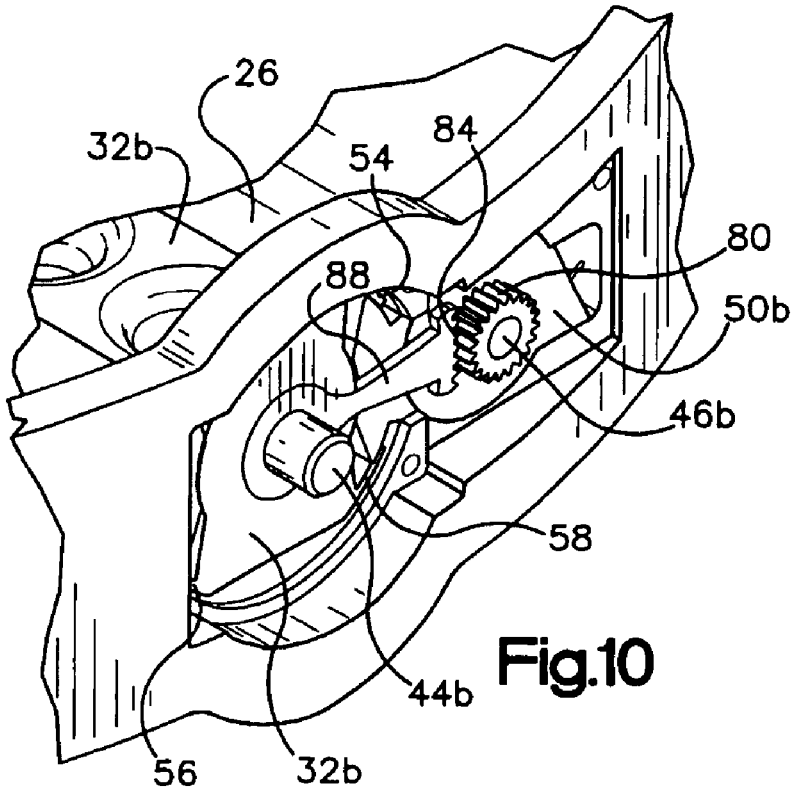
FIG. 10 is a close-up view of a portion of FIG. 9, showing further details.

FIGS. 9 and 10 show the mechanical linkage between the motor 50*a* and the array bar 32*b*. A gear 80 is affixed to the motor shaft 46*b*. The gear 80 engages with a toothed surface 84 of a link 88. The link 88 is attached to the array bar pin 44*b* of the array bar 32*b*. Rotation of the motor shaft 46*b* of the motor 50*b* causes the link 88 to rotate, thereby rotating the array bar 32*b*.

It will be appreciated that other types of mechanical linkages may be employed for transmitting rotation of the motor 50*a* to the array bar 32*a*. Such suitable linkages may involve a wide variety of mechanical devices, such as gears, belts, and cams and followers, for example.

Figure 11:
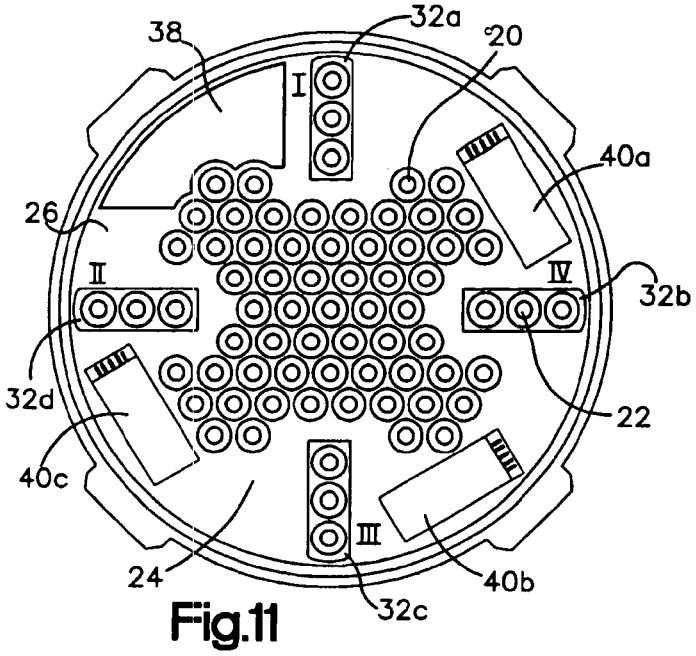
FIGS. 11–14 are end views showing various possible orientations of movable nozzles for the control system of FIG. 2.

FIGS. 11–14 illustrate various configurations of the array bars 32*a*–32*d,* to produce certain forces on the missile 10. FIG. 11 shows straight, non-vectored thrust, with all of the array bars 32*a*–32*d* in null positions. That is, the array bars 32*a*–32*d* are positioned such that all of the movable nozzlettes 22 are pointed straight back.

Figure 12:
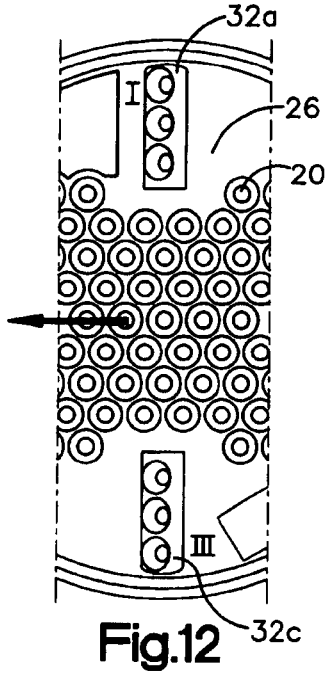
Figure 13:
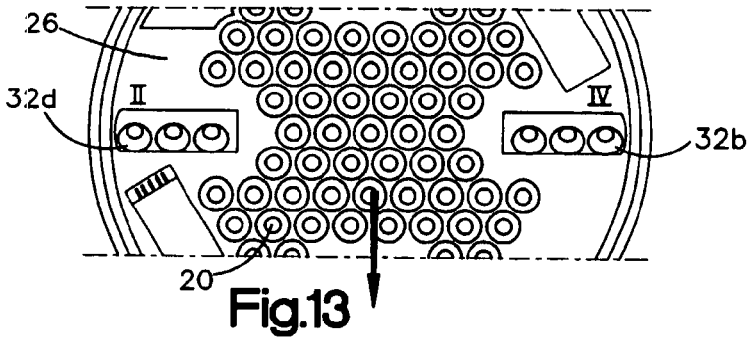

FIG. 12 shows the top and bottom array bars 32*a* and 32*c* tilted in the same direction, thereby providing a yaw moment to the missile 10. If instead the other two array bars 32*b* and 32*d* are tilted, a roll moment is provided to the missile 10, as illustrated in FIG. 13. It will be appreciated that both yaw and roll may be applied at the same time, by appropriately tilting both opposite pairs of the array bar (32*a* and 32*c,* and 32*b* and 32*d*).

Figure 14:
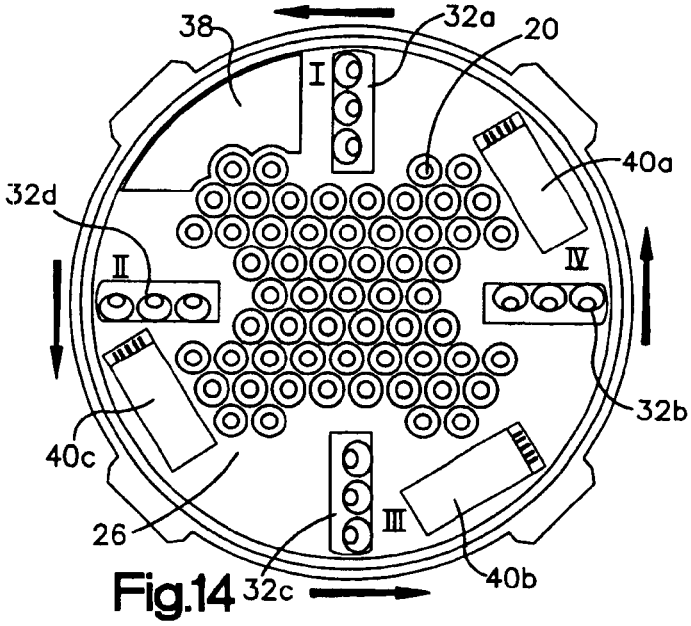

FIG. 14 illustrates tilting of the array bars 32*a*–32*d* to produce a spinning torque on the missile 10. FIG. 14 illustrates the array bars 32*a*–32*d* tilted so as to provide a counter-clockwise spin on the missile 10.

It will be appreciated that the array bars 32*a*–32*d* may be otherwise controlled so as to provide combinations of the motions described above. For example, yaw and/or roll may be combined with spinning, by appropriately controlling location of the array bars 32*a*–32*d*.

Further, it will be appreciated that many alternative arrangements and orientations for array bars are possible.

Figure 15:
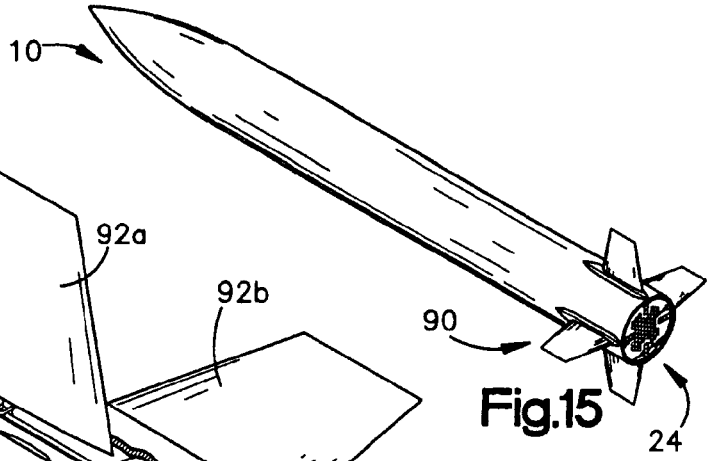
FIG. 15 is an isometric view of an alternative embodiment missile, which utilizes actuable fins.
Figure 16:
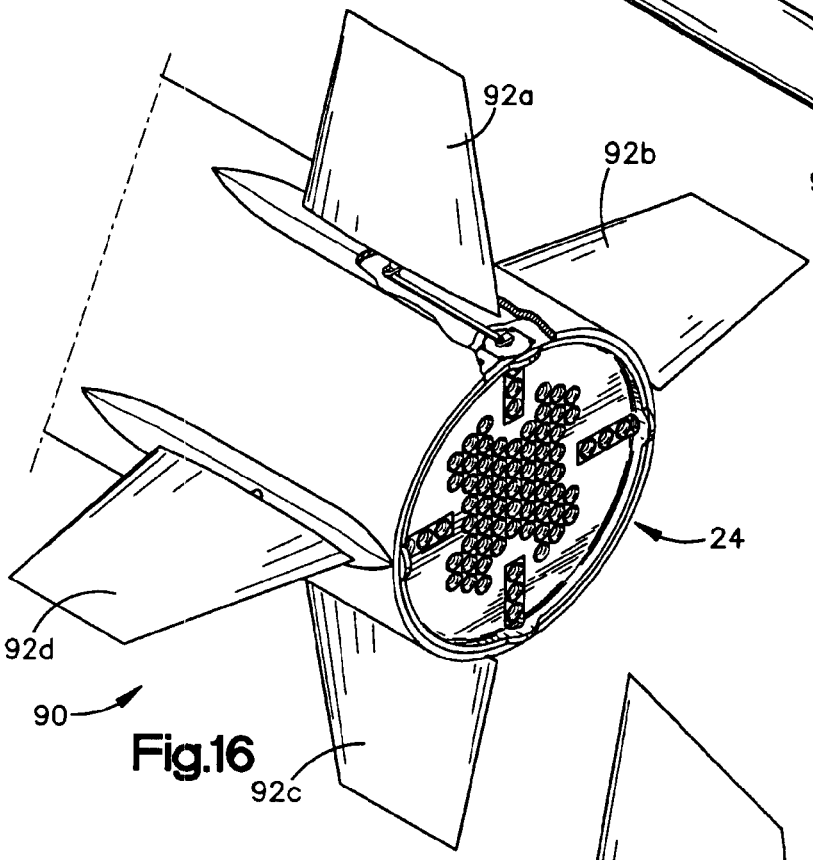
FIG. 16 is a close-up view of a portion of the missile of FIG. 15.
Figure 17:
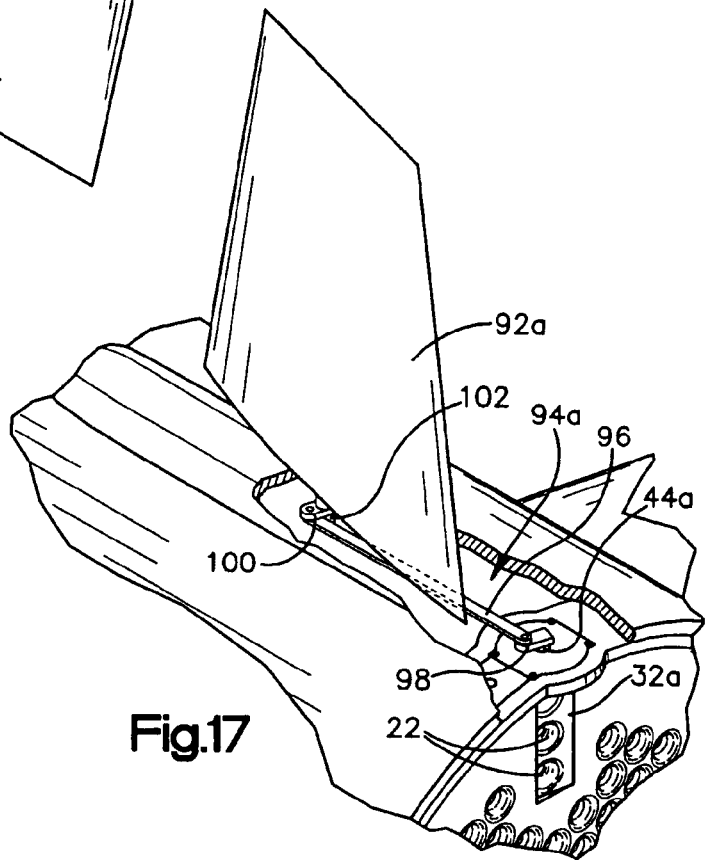
FIG. 17 shows details of the fin-bar linkage between an array bar and a fin of the missile of FIG. 15.

FIGS. 15–17 show another embodiment missile or projectile 10, which has an aerodynamic control system 90 that is mechanically coupled to the thrust vector control system 24. As shown in FIGS. 15–17, fins 92*a*–92*d* of the aerodynamic control system 90 are coupled to respective of the array bars 32*a*–32*d* of the thrust vector control system 24 via respective fin-bar linkages, such as the fin-bar linkage 94*a* shown in FIG. 17.

The illustrated fin-bar linkage 94*a* is a four-bar linkage. The fin-bar linkage 94*a* includes a rod or member 96 that is coupled to an extension 98 on the array bar pin 44*a* and is coupled to a protrusion 100 on the fin pin 102. Rotation of the array bar pin 44*a* causes movement of the router member 96, which in turn causes the fin 92*a* to rotate about the shaft of the fin pin 102, thus rotating the fin 92*a*. The fin 92*a* may thus be tilted relative to the remainder of the missile 10.

It will be appreciated that there are many ways of mechanically coupling the fins 92*a*–92*d* and the array bars 32*a*–32*d* so that movement of the array bars 32*a*–32*d* causes corresponding movement of the fins 92*a*–92*d*. For example, the array bars and the fins may both be separately mechanically coupled to the motors.

Mechanically coupling the array bars 32*a*–32*d* and the fins 92*a*–92*d* advantageously allows a single control system, and a single set of motors, to achieve vector control of the missile 10. The array bars 32*a*–32*d,* with their moveable nozzlettes 22, may be the principal way of changing missile course during a powered phase of the flight of the missile 10. The fins 94*a*–94*d* may be utilized to control the missile flight during an unpowered phase of flight, after the propulsion system has consumed all of its propellant. Thus by combining thrust vector control with aerodynamic control actuation components, control will be maintained throughout missile flight, powering the thrust vector control system during missile launch when limited missile velocity constrains aero-control effectiveness, then utilizing the aerodynamic control fin surfaces for flight directional stability as aerodynamic pressure builds up immediately prior to rocket burn-out. Since the thrust vector control system of the array bars 32*a*–32*d* with their movable nozzlettes 22 is mechanically coupled with the fins 92*a*–92*d,* no dual redundant control actuation system would be required. This greatly reduces overall system complexity, parasitic weight, and assembly costs, when compared with state-of-the-art single nozzle concepts.

More generally, combining the multi-nozzle grid with thrust vector control allows a reduction in weight as compared with prior systems thrust vector control. In addition, the system such as that described above may advantageously produce greater functionality than prior art systems, for example, such as by enabling roll control and/or production and control of spin in the missile. In addition, cost savings may be produced when compared to prior systems, both in use of less material and less expensive materials, such as phenolics, and less expensive manufacturing methods, such as casting.

Compared with jet vane thrust vector control devices, a system with tiltable array bars may have much less degradation of rocket motor performance. Further, unlike jet vanes or jet tabs, the array bars 32*a*–32*d* of the present system need not be jettisoned during flight.

A system such as that described above is more desirable over known jet tab, movable nozzle, detachable or ejectable jet vanes, and retractable jet vanes, due to superior weight optimization, pitch-over stability, cost effectiveness, and system simplification, as well as due to superior risk reduction characteristics. Significant weight savings are realized over tungsten/steel sandwich jet tabs and large gimbaled nozzle actuation systems.

Although the invention has been shown and described with respect to a certain preferred embodiment or embodiments, it is obvious that equivalent alterations and modifications will occur to others skilled in the art upon the reading and understanding of this specification and the annexed drawings. In particular regard to the various functions performed by the above described elements (components, assemblies, devices, compositions, etc.), the terms (including a reference to a "means") used to describe such elements are intended to correspond, unless otherwise indicated, to any element which performs the specified function of the described element (i.e., that is functionally equivalent), even though not structurally equivalent to the disclosed structure which performs the function in the herein illustrated exemplary embodiment or embodiments of the invention. In addition, while a particular feature of the invention may have been described above with respect to only one or more of several illustrated embodiments, such feature may be combined with one or more other features of the other embodiments, as may be desired and advantageous for any given or particular application.

What is claimed is:

1. A missile comprising:

a nozzle grid including:
a plurality of fixed nozzles; and
a plurality of movable nozzles; and a pressurized gas source operatively coupled to the nozzle grid;

wherein the movable nozzles are divided up into plural separately-actuatable arrays; and wherein the movable nozzles of each of the arrays are in a separate array bar.

2. The missile of claim 1, wherein the missile includes four array bars.

3. The missile of claim 1, wherein the array bars are axisymmetrically spaced about an axis of the missile.

4. The missile of claim 1, wherein the array bars are configured to be tilted along respective array bar axes, to thereby change orientation of the movable nozzles of the corresponding array bar.

5. The missile of claim 4, further comprising motors operatively coupled to respective of the array bars;

wherein the motors are configured to individually tilt the array bars.

6. The missile of claim 1, wherein the fixed nozzles are parts of a nozzle plate; and wherein the array bars are movable within openings in the nozzle plate.

7. The missile of claim 1, wherein the array bars have deformable extensions located within cavities in the nozzle plate; and wherein the deformable extensions are configured to press against walls of the cavities when under pressure, thereby forming a seal between the array bar and the nozzle plate.

8. A missile comprising:

a nozzle grid including:
a plurality of fixed nozzles; and
a plurality of movable nozzles; and a pressurized gas source operatively coupled to the nozzle grid;

wherein the fixed nozzles and the movable nozzles are all in communication via a high pressure chamber upstream of the fixed nozzles and the movable nozzles.

9. The missile of claim 8, wherein the fixed nozzles are parts of a nozzle plate.

10. The missile of claim 9, wherein the movable nozzles are movable within openings in the nozzle plate.

11. The missile of claim 9, wherein the fixed nozzles are arranged in a substantially cruciform configuration.

12. The missile of claim 11, wherein the movable nozzles are located at least in part between arms of the cruciform configuration.

13. The missile of claim 12, wherein the movable nozzles are divided up into plural separately-actuatable arrays.

14. The missile of claim 13, wherein the movable nozzles of each of the arrays are substantially in a straight line.

15. A missile comprising:

a nozzle grid including:
a plurality of fixed nozzles; and
a plurality of movable nozzles;

a pressurized gas source operatively coupled to the nozzle grid; and movable fins mechanically coupled to the movable nozzles.

16. The missile of claim 15, wherein the movable nozzles are divided up into plural separately-actuatable arrays;

wherein the movable nozzles of each of the arrays are in a separate array bar; and further comprising motors, wherein the motors are each operatively coupled to a respective array bar and a respective fin.

17. A missile comprising:

a thrust vector control system; and an aerodynamic control system mechanically coupled to the thrust vector control system;

wherein the thrust vector control system includes a plurality of movable nozzles; and wherein the aerodynamic control system includes movable fins.

18. The missile of claim 17, wherein the movable nozzles are in multiple array bars; and wherein each of the fins is mechanically coupled to a respective of the array bars.

19. The missile of claim 18, further comprising motors mechanically coupled to the array bars and configured to selectively tilt the array bars;

wherein the array bars and the fins are coupled such that tilting of the array bars results in tilting of the corresponding fins.

20. The missile of claim 18, further comprising a plurality of fixed nozzles in a nozzle plate;

wherein the array bars are located in openings in the nozzle plate.

21. The missile of claim 20, wherein the fixed nozzles are arranged in a substantially cruciform configuration; and wherein the array bars are located at least in part between arms of the cruciform configuration.

22. A method of propelling a missile, comprising:

moving high pressure gas through a plurality of fixed nozzles, to thereby provide thrust to propel the missile; and simultaneously moving the high pressure gas through a plurality of movable nozzles, to thereby provide additional thrust to propel the missile;

wherein the moving the gas through the movable nozzles controls at least one of the following: course of the missile, orientation of the missile, and spin rate of the missile.

23. The method of claim 22, further comprising controlling the missile;

wherein the controlling includes changing orientation of at least some of the movable nozzles.

24. The method of claim 23, wherein the changing orientation includes tilting one or more array bars; and wherein each of the array bars contains multiple of the movable nozzles.

25. The method of claim 24, wherein the controlling also missile.

26. The method of claim 25, wherein the fins are each mechanically coupled to respective of the array bars.

* * * * *